US007538654B2

(12) United States Patent
Ishii

(10) Patent No.: US 7,538,654 B2
(45) Date of Patent: May 26, 2009

(54) TEMPERATURE DETECTOR AND FIXING DEVICE PROVIDED THEREWITH

(75) Inventor: Takeshi Ishii, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 378 days.

(21) Appl. No.: 11/441,338

(22) Filed: May 26, 2006

(65) Prior Publication Data

US 2006/0269308 A1 Nov. 30, 2006

(30) Foreign Application Priority Data

May 30, 2005 (JP) ..... 2005-156949

(51) Int. Cl.
*H01C 7/10* (2006.01)

(52) U.S. Cl. ..... 338/22 R

(58) Field of Classification Search ..... 338/22 R, 338/315, 322, 324, 329; 361/767, 746, 790, 361/704

See application file for complete search history.

(56) References Cited

U.S. PATENT DOCUMENTS 5,929,743 A * 7/1999 Miyazaki et al. ..... 338/22 R
6,377,467 B1 * 4/2002 Chu et al. ..... 361/767
6,785,506 B2 * 8/2004 Kato et al. ..... 399/333

FOREIGN PATENT DOCUMENTS

JP 11-231715 8/1999

* cited by examiner

*Primary Examiner*—Kyung Lee
(74) *Attorney, Agent, or Firm*—Smith, Gambrell & Russell, LLP

(57) ABSTRACT

A temperature detector 163 according to the invention is so configured as to include a polyimide sheet 163*a* on which a temperature detection part 163*b* is mounted, the temperature detection part 163*b* which is provided on the polyimide sheet 163*a* and which is composed of a thermistor or the like for temperature detection, a polyimide sheet 163*e* which is provided on the temperature detection part 163*b* and which serves as a protection member for protecting the temperature detection part 163*b*, a high thermal conductive layer 163*f* which is formed within an outer circumference of the polyimide sheet 163*e*, and a high thermal conductive fluorine resin layer 163*g* which is so formed as to cover the polyimide sheet 163*e* and the high thermal conductive layer 163*f*.

9 Claims, 5 Drawing Sheets

--Related Art--

--Related Art--

TEMPERATURE DETECTOR AND FIXING DEVICE PROVIDED THEREWITH

BACKGROUND OF THE INVENTION

This application is based on JP-A-2005-156949 filed on May 30, 2005, the contents of which are hereby incorporated by reference.

1. Field of the Invention

The present invention relates to a temperature detector for measuring the surface temperature of a temperature-measured object, such as a fixing roller or the like, in an image forming apparatus, such as a copier, a printer, a facsimile, or the like, and also to a fixing device including this temperature detector.

2. Description of the Prior Art

Conventionally, in an image forming apparatus that forms a toner image on paper to thereby obtain a visible image, for example, as shown in FIG. 6, a toner image formed on paper P is fixed by having the paper P pass through a pressure-contact portion between a fixing roller 52 (heating roller) having a halogen lamp 51 built therein as a heat source and a pressure roller 53, which are both included in a fixing part 50 (that is, fixing device), and then applying heat and pressure to the toner on the paper P. An arrow with a solid line denotes the conveyance direction of the paper P.

To obtain a favorable toner image on the paper P in the fixing processing, it is required to maintain the fixing roller 52 at a previously set adequate temperature in the fixing processing. Thus, as shown in FIG. 6, with a temperature detector 54 placed in contact with the surface of the fixing roller 52, ON-OFF control of the halogen lamp 51 is performed based on the output of the temperature detector 54.

The conventional temperature detector 54 that detects the temperature of the fixing roller 52 has, as shown in FIG. 7, a temperature detection part 55, such as a thermistor or the like, sandwiched between polyimide sheets 56 and 57 which are provided in an orange color as protection members therefor. Then, the temperature detection part 55 is protected, by the polyimide sheet 56 placed in contact with the surface of the fixing roller 52, from friction with the fixing roller 52.

Disclosed and suggested in technical literature as a reference for a temperature detector is a temperature detection unit in which a metal piece is arranged between a protection member of a Teflon (registered trademark) sheet in contact with a fixing roller and a temperature detection element and then an insulating heat-resistant sheet is disposed between the metal piece and the temperature detection element (for example, see patent publication 1).

[Patent Publication 1] JP-A-H11231715

The conventional temperature detector 54 definitely can protect the temperature detection part 55, by the polyimide sheet 56, from the friction with the fixing roller 52, and also can detect the surface temperature of the fixing roller 52 as a temperature-measured object.

With the temperature detection unit disclosed in patent publication 1, the temperature of the fixing roller can be detected without causing temperature misdetection by the temperature detection element due to insulation failure. Moreover, since the protection member in contact with the fixing roller is a Teflon (registered trademark) sheet, adhesion of the toner, which has adhered to the fixing roller, to the protection member can be reduced.

However, in the conventional temperature detector 54, the polyimide sheet 56 protecting the temperature detection part 55 has low heat conductivity and exhibits low heat absorbing performance (heat collection effect ) for radiant heat due to its surface colored in orange; therefore, heat is not efficiently conducted from the fixing roller 52 to the temperature detection part 55, thus resulting in low responsiveness of the temperature detection part 55 in temperature detection. Moreover, as means for improving the responsiveness of the temperature detection part 55 in temperature detection, it is possible to provide the polyimide sheet 56 with a thin thickness, although this results in decreased endurance of the polyimide sheet 56. Furthermore, the conventional temperature detector 54 has a risk that the toner, which has adhered to the fixing roller 52, adheres to the polyimide sheet 56 thereby causing misdetection of the surface temperature of the fixing roller 52.

Further, the temperature detection unit disclosed in patent publication 1 has the protection member, the metal piece, and the insulating heat-resistant sheet that are only stacked one on the other, thus having room for improvement in the responsiveness of the fixing roller in temperature detection.

SUMMARY OF THE INVENTION

In view of the problem described above, the present invention has been made, and it is an object of the invention to provide a temperature detector capable of detecting the temperature of a temperature-measured object with favorable responsiveness and accuracy and also capable of preventing a toner from adhering to a surface thereof in contact with the temperature-measured object, and to a fixing device including this temperature detector.

To achieve the object described above, one aspect of the invention refers to a temperature detector including: a temperature detection part that indirectly detects the surface temperature of a temperature-measured object; and a protection member that protects the temperature detection part, in which, a high thermal conductive layer of metal and a high thermal conductive fluorine resin layer are formed in the order named.

According to this configuration, the heat conduction to the temperature detection part improves, thus permitting accurate detection of the surface temperature of the temperature-measured object with favorable responsiveness. Moreover, the high thermal conductive fluorine resin layer is formed, thus permitting improvement in the sliding performance on the temperature-measured object and also permitting preventing adhesion of a member such as a toner or the like that causes misdetection of the temperature.

In the temperature detector with the configuration described above, the high thermal conductive layer is formed within the outer circumference of the protection member.

According to this configuration, electric leak caused by contact between the high thermal conductive layer of metal and the temperature detection part, and heat leak caused by contact between the high thermal conductive layer and a member other than the temperature detector can be prevented.

In the temperature detector with the configuration described above, the color of the high thermal conductive fluorine resin layer is black.

According to this configuration, radiant heat from the temperature-measured object can be efficiently absorbed by the high thermal conductive fluorine resin layer.

Another aspect of the invention refers to a fixing device including the temperature detector with the configuration described above.

According to this configuration, the surface temperature of the fixing roller can be accurately detected with favorable responsiveness. Moreover, the sliding performance between the fixing roller and the temperature detector improves, thus permitting preventing toner adhesion and also abrasion on the surface of the fixing roller.

DESCRIPTION OF THE PREFERRED EMBODIMENTS

Figure 1:
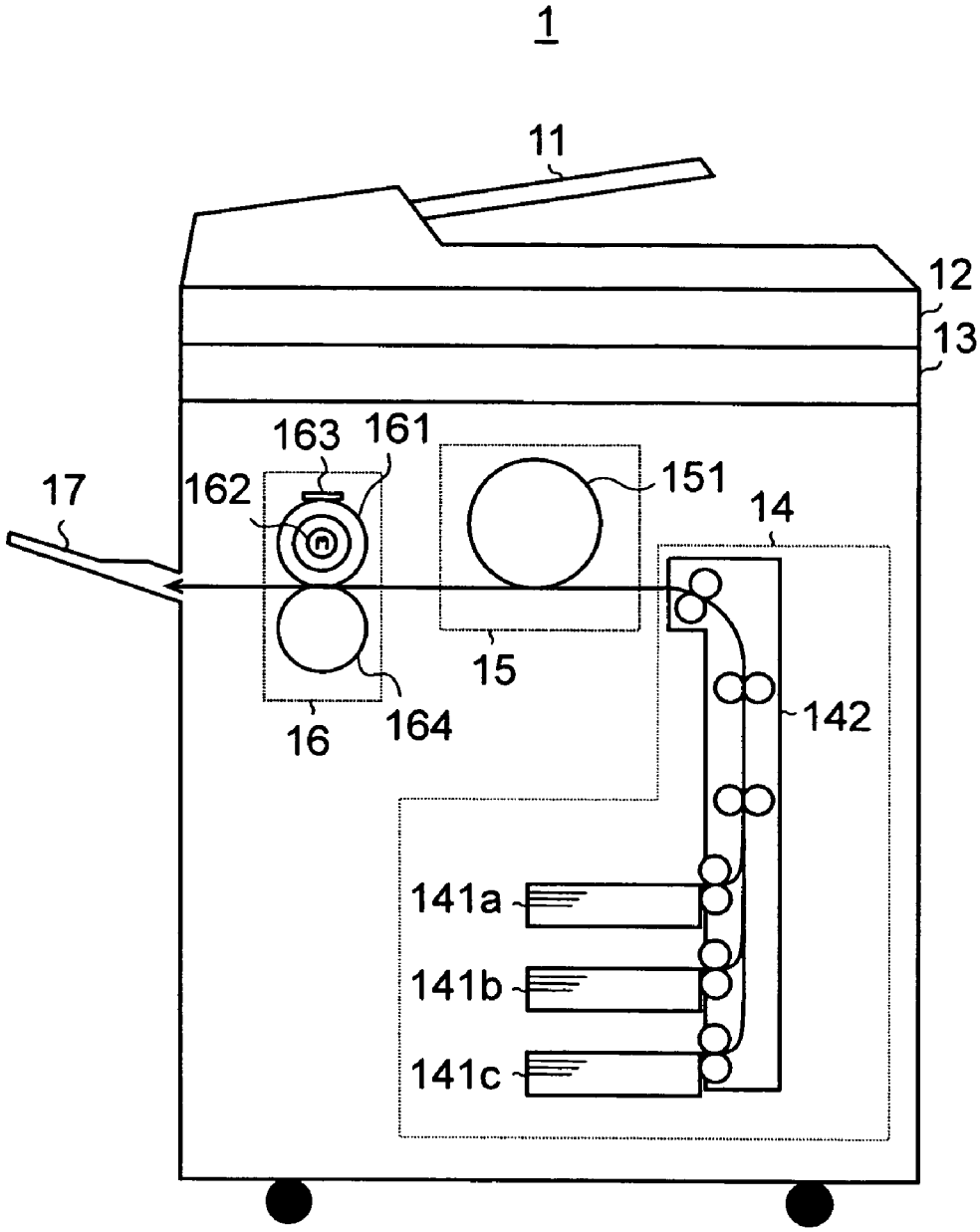
FIG. 1 is a longitudinal cross section schematically showing a major part structure of a copier including a temperature detector according to the present invention.

Hereinafter, an embodiment of the invention will be described with reference to the accompanying drawings, illustrating as an example a copier having a temperature detector according to the invention included in a fixing part (corresponding to a fixing device). FIG. 1 is a longitudinal cross section schematically showing a major part structure of a copier including the temperature detector according to the invention.

The copier 1 is so formed as to include, as shown in FIG. 1, a document conveyance part 11 that automatically conveys a document, a document input part 12 that takes in a document conveyed from the document conveyance part 11 to generate image data, an operation display part 13 composed of operation means (a numerical keypad, a touch panel, or the like) and display means (a liquid crystal display or the like), an image formation part 15 (including a print part 151 composed of a printer head, a photoconductive drum, and the like) that forms a toner image onto paper based on image data, a paper feed part 14 that feeds paper to the image formation part 15, a fixing part 16 that fixes a toner image formed on paper by the image formation part 15 by applying heat and pressure, and a paper discharge part 17 that serves as a discharge destination of paper with a toner image fixed thereon by the fixing part 16. Note that, although not shown in this figure, the copier 1 of course has a central processing unit (hereinafter referred to as CPU) that controls operation of the entire apparatus, a memory part composed of a ROM (Read Only Memory) storing various control programs and the like and a RAM (Random Access Memory) used as a work region, and the like.

The paper feed part 14 is so formed as to have paper storage parts 141*a* to 141*c* serving as a source of paper fed to the image formation part 15 and provided in a plurality of stages (three stages in this embodiment), and a paper conveyance part 142 serving as a common paper conveyance path from the paper storage parts 141*a* to 141*c* to the image formation part 15.

The fixing part 16 is so formed as to have: a halogen lamp 162 which is controlled by the CPU (not shown) based on a value outputted from a temperature detector 163 to be described later in order to maintain an optimum temperature required for fixing processing to thereby heat a fixing roller 161 to be described later; the fixing roller 161 which is heated by the halogen lamp 162 arranged therein to thereby apply heat and pressure to paper which passes through a portion abutting a pressure roller 164 to be described later and which has a toner image formed thereon, the temperature detector 163 that makes contact with the surface of the fixing roller 161 to detect the temperature of the fixing roller 161, and the pressure roller 164 that abuts the fixing roller 161 and applies pressure to paper which passes through the abutting portion and which has a toner image formed thereon. The temperature detector 163 inputs into the CPU (not shown) an output in accordance with the detected temperature.

Next, document copy operation performed in the copier 1 with the configuration described above will be described. In the document copy operation performed in the copier 1, a document is first conveyed from the document conveyance part 11 to the document input part 12, by which the document is taken (image data is generated). The generated image data is once stored into the memory part (not shown), then read again and transmitted to the image formation part 15. Subsequently, in the image formation part 15, processing of forming a toner image onto paper is performed based on the inputted image data. Then, based on an output from the temperature detector 163, the halogen lamp 162 is controlled so that, in the fixing part 16 where the optimum temperature required for fixing processing is maintained, the toner image formed on the paper is fixed onto the paper. Then, the paper with the toner image fixed thereon is discharged to the discharge part 17.

Figure 2:
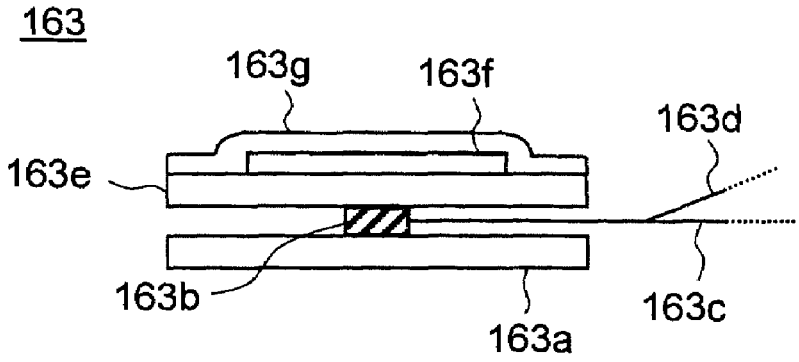
FIG. 2 is a longitudinal cross section schematically showing a major part structure of the temperature detector according to the invention.
Figure 3:
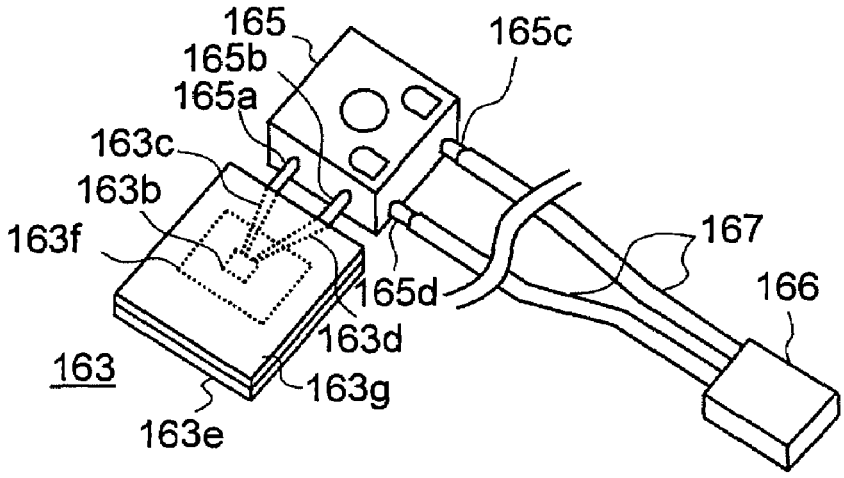
FIG. 3 is a perspective view schematically showing the temperature detector fitted to a holder.
Figure 4:
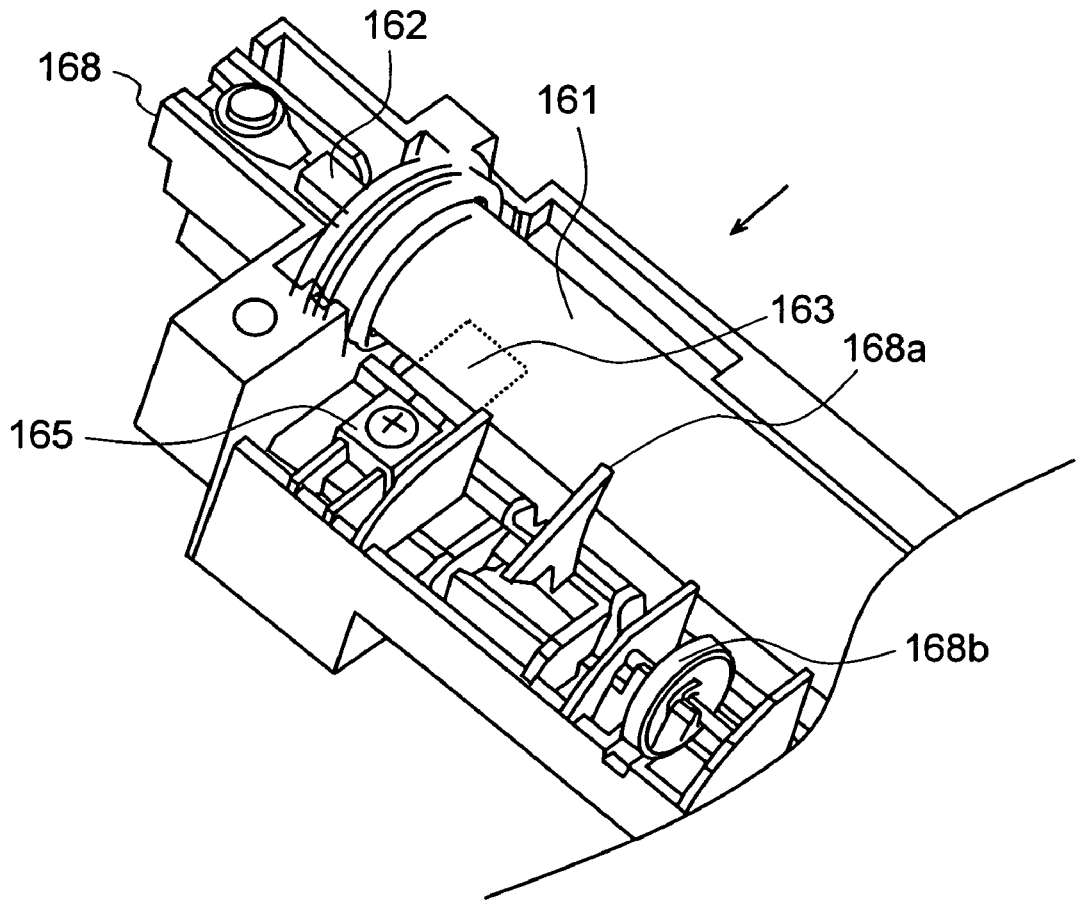
FIG. 4 is a perspective view schematically showing the temperature detector fitted to a fixing roller support housing when viewed from a pressure roller side.

Next, the temperature detector 163 according to the invention included in the fixing part 16 of the copier 1 will be described below. FIG. 2 is a longitudinal cross section schematically showing a major part structure of the temperature detector according to the invention. FIG. 3 is a perspective view schematically showing the temperature detector fitted to a holder. FIG. 4 is a perspective view schematically showing the temperature detector fitted to a fixing roller support housing as viewed form a pressure roller side.

The configuration of the temperature detector 163 according to the invention will be described, starting with the lower layer side (lower side in FIG. 2). The temperature detector 163 according to the invention is formed of: as shown in FIG. 2, a polyimide sheet 163*a* on which a temperature detection part 163*b* to be described later is mounted, the temperature detection part 163*b* which is provided on the polyimide sheet 163*a* and composed of a thermistor or the like for detecting a temperature, a polyimide sheet 163*e* which is provided on the temperature detection part 163*b* and serves as a protection member for protecting the temperature detection part 163*b*, a high thermal conductive layer 163*f* which is formed within the outer circumference of the polyimide sheet 163*e*, a high thermal conductive fluorine resin layer 163*g* which is so formed as to cover the polyimide sheet 163*e* and the high thermal conductive layer 163*f*.

The temperature detection part 163*b* includes: as shown in FIG. 2, two lead wires 163*c* and 163*d*. In this example, each of the polyimide sheets 163*a* and 163*e* has a thickness of approximately 50 μm and is shaped into a square with one side thereof having a length of approximately 10 mm.

For the high thermal conductive layer 163*f*, metal of high heat conductivity, such as aluminum, copper, gold, silver, or the like can be used. The high thermal conductive layer 163*f* is formed on the polyimide sheet 163*e* by using a layer formation method, such as vacuum deposition, enhanced chemical vapor deposition (CVD), physical vapor deposition (PVD), or the like, so as to be formed into a thickness of approximately 20 to 30 μm within the outer circumference of the polyimide sheet 163*e* with favorable adhesiveness. The formation of the high thermal conductive layer 163*f* within the outer circumference of the polyimide sheet 163*e* permits preventing electric leak from the lead wire 163*c* and heat leak caused by contact with a member outside the temperature detector 163. For the high thermal conductive layer 163*f*, an alloy of metal, such as aluminum, copper, gold, silver, or the like may be used.

The high thermal conductive fluorine resin layer 163*g* is formed of a material in a black color, which provides high heat storage effect for radiant heat (black color since carbon is contained), having a heat conductivity of 0.2 w/m degrees or more so as to cover the polyimide sheet 163*e* and the high thermal conductive layer 163*f* with favorable adhesiveness. The high thermal conductive fluorine resin layer 163*g* has favorable sliding performance on a different member; thus, the formation of the high thermal conductive fluorine resin layer 163*g* permits an improvement in the sliding performance on a temperature-measured object that is in contact with the surface of the high thermal conductive fluorine resin layer 163*g*. Thus, the temperature detector 163 can prevent toner adhesion and also abrasion on the surface of the fixing roller 161.

The temperature detector 163 with the configuration described above is, when used for detecting the surface temperature of the fixing roller 161 as a temperature-measured object, fixed to a holder 165 by fitting the lead wires 163*c* and 163*d* to terminals 165*a* and 165*b* of the holder 165, respectively, as shown in FIG. 3. Moreover, the temperature detector 163 is electrically connected to a connector 166 via: the lead wires 163*c* and 163*d*, the terminals 165*a* and 165*b* of the holder 165, terminals 165*c* and 165*d* electrically connected to the terminals 165*a* and 165*b* in the holder 165, and a wiring 167 electrically connected to the terminals 165*c* and 165*d*. Furthermore, an output of the temperature detector 163 is inputted into the CPU (not shown) via the connector 166 or the like.

The temperature detector 163 fixed to the holder 165 is fitted, as shown in FIG. 4, by screwing the holder 165 with a fixing roller support housing 168 to which the fixing roller is rotatably fitted. The temperature detector 163 is arranged so that the high thermal conductive fluorine resin layer 163*g* is in contact with the roller surface of the fixing roller 161 on the fixing roller support housing 168 side. The fixing roller support housing 168 is so formed as to have, as shown in FIG. 4, in addition to the fixing roller 161 provided with the halogen lamp 162, a separation pawl 168*a* for separating paper with a toner fixed thereon from the fixing roller 161 and the pressure roller 164, and a roller 168*b* for smoothly delivering paper separated by the separation pawl 168*a* to the paper discharge part 17. An arrow with a solid line in FIG. 4 denotes the paper conveyance direction.

As described above, in the temperature detector 163 fitted to the fixing part 16, heat conduction from the fixing roller 161 to the temperature detection part 163*b* will be described below, with reference to FIGS. 1, 2, and 4.

The heat of the fixing roller 161 as a temperature-measured object is conducted to the high thermal conductive fluorine resin layer 163*g* of the temperature detector 163 through the surface contact therebetween. In addition, since the color of the high thermal conductive fluorine resin layer 163*g* is black which provides high absorption effect of radiant heat, radiant heat from the fixing roller 161 is efficiently absorbed by and conducted to the high thermal conductive fluorine resin layer 163*g*.

Then, since the high thermal conductive fluorine resin layer 163*g* has high heat conductivity and also is formed on the high thermal conductive layer 163*f* with favorable adhesiveness (that is, large contact area), heat conducted from the fixing roller 161 to the high thermal conductive fluorine resin layer 163*g* is efficiently and quickly conducted to the high thermal conductive layer 163*f*.

The high thermal conductive layer 163*f* is formed of metal with high heat conductivity and is also formed on the polyimide sheet 163*e* with favorable adhesiveness (that is, large contact area), heat conducted from the high thermal conductive fluorine resin layer 163*g* to the high thermal conductive layer 163*f* is efficiently and quickly conducted to the polyimide sheet 163*e*. Then, heat conducted from the fixing roller 161 to the polyimide sheet 163*e* is conducted from the polyimide sheet 163*e* to the temperature detection part 163*b*. In the temperature detection part 163*b*, an output is provided in accordance with the temperature of the heat conducted from the surface of the fixing roller 161 as described above.

Next, the responsiveness of the fixing roller 161 in temperature detection in the copier 1 having the temperature detector 163 according to the invention provided in the fixing part 16 will be described with reference to the drawings.

Figure 5:
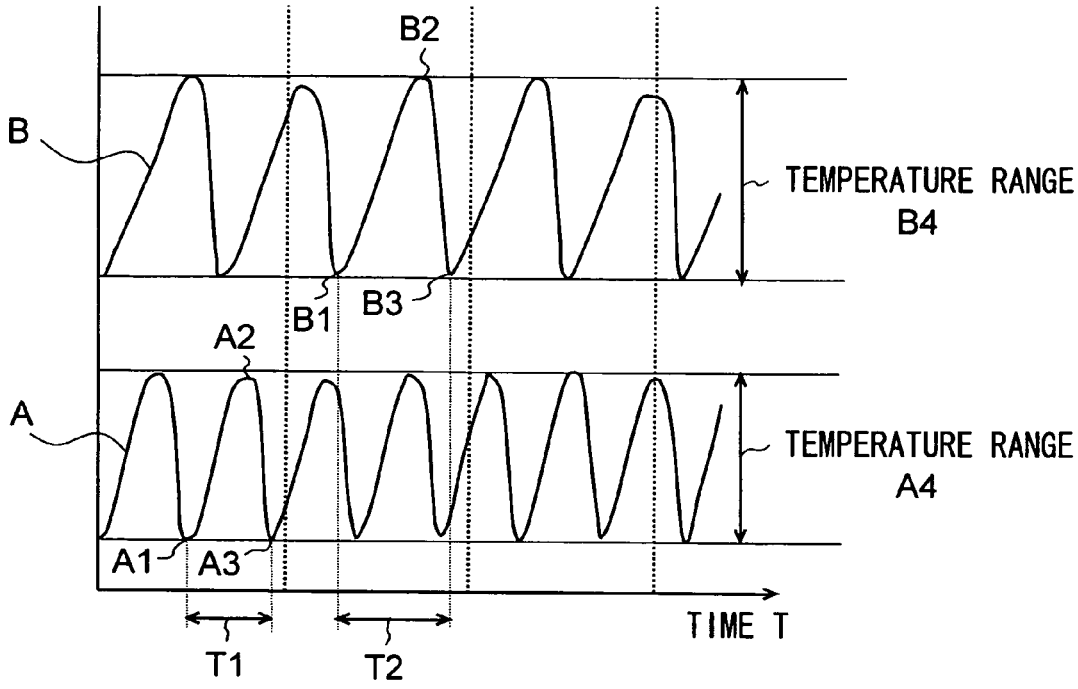
FIG. 5 is a graph for explaining the responsiveness of a conventional temperature detector according to the invention in temperature detection.
Figure 6:
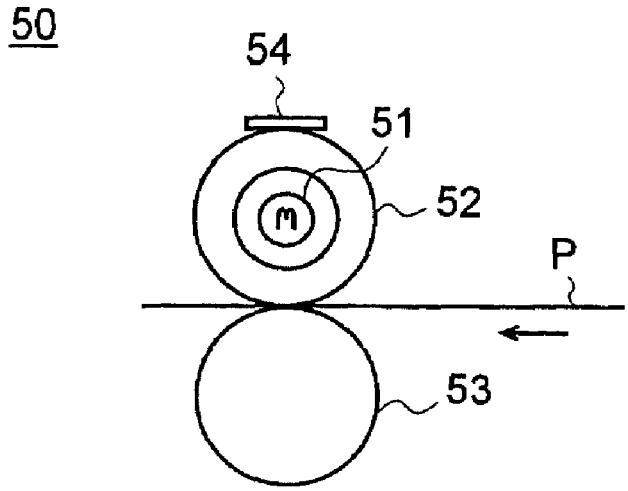
FIG. 6 is a longitudinal cross section schematically showing a fixing part including the conventional temperature detector.
Figure 7:
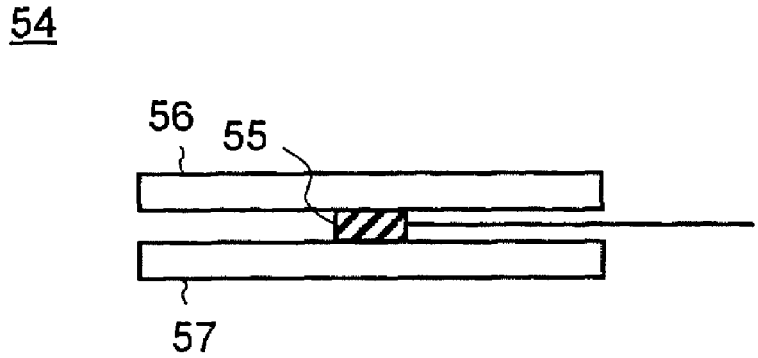
FIG. 7 is a longitudinal cross section schematically showing a major part structure of the conventional temperature detector.

FIG. 5 is a graph showing the relationship between the temperature and time in a stable state in a case where the temperature detector 163 according to the invention and the conventional temperature detector 54 shown in FIG. 7 detect the surface temperature of the respective fixing rollers 161 and then the halogen lamp 162 is controlled by the CPU (not shown) so as to maintain the optimum temperature for fixing processing. The horizontal axis indicates time T.

Curved lines A and B shown in FIG. 5 indicate results of the surface temperature of the respective fixing rollers 161 measured by the temperature detector 163 according to the invention and the conventional temperature detector 54 shown in FIG. 7.

As shown in FIG. 5, in the temperature detector 163 and the conventional temperature detector 54, the fixing roller 161 is held at the optimum temperature for fixing processing by repeating a cycle in which: after the temperature as a base point for the lighting up of the halogen lamp 162 is detected and then the halogen lamp 162 lights up, minimum temperatures A1 and B1 are detected; then after the temperature as a base point for the lighting off of the halogen lamp 162 is detected and then the halogen lamp 162 lights off, maximum temperatures A2 and B2 are detected; and then after the temperature as the base point for lighting up of the halogen lamp 162 is detected again and then the halogen lamp 162 lights up, minimum temperatures A3 and B3 are detected. The time required for one cycle described above (time from the minimum temperatures A1 and B1 to the minimum temperatures A3 and B3) is time T2 in the case of the conventional temperature detector 54 (curved line B) and time T1, which is shorter than time T2, in the case of the temperature detector 163 according to the invention (curved line A).

The description given above proves that the temperature detector 163 according to the invention has better heat conductivity than the conventional temperature detector 54, and thus has better responsiveness of a temperature-measured object in temperature detection than the conventional temperature detector 54. Moreover, it is estimated based on FIG. 5 that the temperature detector 163 according to the invention has responsiveness of a temperature-measured object in temperature detection which is approximately 20% better than that of the conventional temperature detector 54.

Moreover, the temperature detector 163 according to the invention has better heat conductivity for heat from the temperature-measured object than the conventional temperature detector 54 has; therefore, a more accurate value of the temperature serving as a base point for ON/OFF control of the halogen lamp 162 is provided. Thus, as shown in the curved lines A and B of FIG. 5, when the temperature detector 163 according to the invention is used (the curved line A), the surface of the fixing roller 161 can be controlled over a temperature range A4, which is narrower than a temperature range B4 employed when the conventional temperature detector 54 is used (curved line B).

As described above, with the copier 1 having the temperature detector 163 of this embodiment included in the fixing part 16 (corresponding to a fixing device), the temperature detector 163 has better heat conductivity to the temperature detection part 163*b*, thus permitting accurate detection of the surface temperature of the fixing roller 161 with favorable responsiveness. Moreover, the temperature detector 163 has the high thermal conductive fluorine resin layer 163*g* at an area in contact with the fixing roller 161 as a temperature-measured object; therefore, sliding performance on the fixing roller 161 improves, thus permitting preventing toner adhesion and also abrasion on the surface of the fixing roller In the description above, the temperature detector 163 according to the invention is used for detection of the surface temperature of the fixing roller 161 in the copier 1, but may also be used for temperature detection of a temperature-measured object other than the fixing roller 161.

Moreover, various modifications, other than the embodiment described above, can be added to the configuration of the invention without departing from the sprit of the invention.

The invention is widely applicable to temperature detectors in general that measure the surface temperature of a temperature-measured object, such as a fixing roller or the like, in an image forming apparatus, such as a copier, a printer, a facsimile, or the like, and also applicable to fixing devices in general including the temperature detector; therefore, the invention provides a technology useful for improving the responsiveness in temperature detection.

What is claimed is:

1. A temperature detector comprising:

a temperature detection part that indirectly detects a surface temperature of a temperature-measured object; and a protection member that protects the temperature detection part;

wherein, on a surface, opposite to the temperature detection part, of the protection member fitted at a temperature-measured object side of the temperature detection part, a high thermal conductive layer of metal and a high thermal conductive fluorine resin layer are formed in an order named.

2. The temperature detector of claim 1, wherein the high thermal conductive layer is larger than an outer circumference of the temperature detection part and formed within an outer circumference of the protection member.

3. The temperature detector of claim 2, wherein a color of the high thermal conductive fluorine resin layer is black.

4. A fixing device comprising the temperature detector of claim 3.

5. A fixing device comprising the temperature detector of claim 2.

6. The temperature detector of claim 1, wherein a color of the high thermal conductive fluorine resin layer is black.

7. A fixing device comprising the temperature detector of claim 6.

8. A fixing device comprising the temperature detector of claim 1.

9. The temperature detector of claim 1, wherein the high thermal conductive fluorine resin layer has a heat conductivity of 0.2 w/m° C. or more.

* * * * *